US005431218A

United States Patent [19]

Lelievre

[11] Patent Number: 5,431,218

[45] Date of Patent: Jul. 11, 1995

[54] HEAT EXCHANGER WITH TUBES HAVING EXPANDED MOUTHS

[75] Inventor: Gilbert Lelievre, Change, France

[73] Assignee: Valeo Thermique Moteur, Le-Mesnil-Saint-Denis, France

[21] Appl. No.: 130,581

[22] Filed: Oct. 1, 1993

[30] Foreign Application Priority Data

Oct. 2, 1992 [FR] France ..... 92 11679

[51] Int. Cl.[6] ..... F28F 9/04

[52] U.S. Cl. ..... 165/173; 165/153

[58] Field of Search ..... 165/151, 153, 173, 175; 29/890.043, 890.044

[56] References Cited

U.S. PATENT DOCUMENTS

| | | | |
|---|---|---|---|
| 4,175,308 | 11/1979 | Togashi | 29/890 |
| 4,401,157 | 8/1983 | Cadars | 165/173 |
| 4,682,650 | 7/1987 | Potier | 165/173 |
| 4,967,836 | 11/1990 | Nakamura | 165/173 |
| 5,214,848 | 6/1993 | Lelievre | 29/890.053 |

FOREIGN PATENT DOCUMENTS

| | | |
|---|---|---|
| 1137529 | 5/1957 | France . |
| 2093349 | 1/1972 | France . |
| 2304885 | 10/1976 | France . |
| 2318399 | 2/1977 | France . |
| 1551448 | 4/1979 | Germany . |
| 1353928 | 5/1974 | United Kingdom . |
| 1533466 | 11/1978 | United Kingdom . |

*Primary Examiner*—John Rivell
*Assistant Examiner*—L. R. Leo
*Attorney, Agent, or Firm*—Morgan & Finnegan

[57] ABSTRACT

A heat exchanger, especially a heat exchanger for a motor vehicle, has a header plate which is formed with substantially circular holes, together with a bundle of tubes each having an end portion of modified shape, which is sealingly received in a respective one of the holes in the header plate. Each tube end portion is provided with an expanded mouth, which is formed by deformation of the wall of the tube and which has a polygonal shape which may for example be square, being then defined by sides which are joined together by rounded corners.

7 Claims, 1 Drawing Sheet

HEAT EXCHANGER WITH TUBES HAVING EXPANDED MOUTHS

FIELD OF THE INVENTION

This invention relates to heat exchangers of the kind which are adapted in particular to form part of a motor vehicle, for use either as an engine cooling radiator or as a cabin heating radiator. More particularly, the invention relates to a heat exchanger of the type comprising a header plate which is formed with substantially circular through holes, together with a bundle of tubes, each of which has a shaped end portion which is received sealingly in a respective one of the through holes in the header plate, with each tube end portion being formed with an expanded mouth which is made by deformation of the wall of the tube.

BACKGROUND OF THE INVENTION

In a heat exchanger of the above mentioned type, the expansion of each tube end portion has the general purpose of ensuring that the header plate will be retained on the bundle of tubes, with the additional function of contributing to the sealing of the junction between the tube and the header plate.

The expression "substantially circular" in this specification is to be understood to mean that the holes formed through the header plate, and therefore the cross sections of the tube end portions, are circular in shape, or else they have a shape which is very close to being circular. In this latter case, the shape may be oval or elliptical, being characterised by a major axis of symmetry and a minor axis of symmetry, and being such that the ratio between the length of the major axis and the length of the minor axis is equal to at least 1.2.

In a heat exchanger of the kind described above, sealing between each tube end portion and the header plate is usually ensured by means of a sealing gasket, which is made of an elastomeric material and formed with compressible collar portions, each of which is compressed between the tube end portion and a further collar portion which is part of the header plate and which bounds the corresponding hole in the latter.

In a modification, it is possible to obtain the required sealing by means of a brazed joint, although this type of joint is more often used in the case in which the tube end portions are of flattened or elongated shape, being therefore very different from the circular shape.

In heat exchangers of the known types mentioned above, the substantially circular end portion of each tube is formed with an expanded mouth of matching shape, that is to say the expanded mouth is substantially circular; it extends over the whole periphery of the tube end portion. In the case in which the tube end portion is received in a respective one of the said holes with a sealing gasket interposed, the dimensions of the expanded mouth are generally close to those of the hole. The operation of making such an expanded mouth over the whole periphery of the end portion of the tube gives rise to a risk of creating cracks or tears in the latter, which is detrimental to sealing of the heat exchanger.

In order to overcome this disadvantage, it has been necessary up to the present time, especially in the case where the tubes are of aluminium alloys, to ensure that they have a specific metallurgical condition. This increases the selling price of the heat exchanger.

In the case of heat exchangers in which the end portions of the tubes have a non-circular cross section which is markedly different from the shape of a circle, these end portions are flattened or elongated and have two opposed long sides, which are straight or curved. It is known to provide an expanded mouth in such a case, but the known way of providing such a mouth is to form two localised deformations, which are provided respectively on the two opposed major sides of the end portion of the tube. This is for example described in the specifications of French patents Nos. 1 157 417, 2 181 497 and 2 525 337.

Moreover, the provision of expanded mouths in that particular form is not suitable for tubes having end portions having an elongated cross section which is substantially different in shape from a circle.

DISCUSSION OF THE INVENTION

Accordingly, an object of the present invention is to overcome the above mentioned drawbacks.

One particular object of the invention is to obtain a heat exchanger of the type described above, in which it is possible to form an expanded mouth for each tube end portion without giving rise to any danger of cracks or tears developing.

Another object of the invention is to provide such a heat exchanger which can be made without any increase in its selling price.

One particular object of the invention is to provide such a heat exchanger which is more particularly, though not exclusively, suitable for assembly of the mechanical type as compared with the brazed type.

According to the invention, a heat exchanger comprising a header plate having substantially circular holes, together with a bundle or tubes, in which each said tube has an end portion of modified shape, which is received sealingly in a respective one of the said holes in the header plate, with each said tube end portion being formed with an expanded mouth which is obtained by deformation of the wall of the tube, is characterised in that the expanded mouth has a polygonal shape which is defined by at least three sides joined together through rounded corners.

The present Applicants have found that such an expanded mouth, of polygonal shape, can easily be obtained using an appropriate tool such as a punch. In addition, the formation of such an expanded mouth enables the friction forces of the expanding tool to be reduced. This not only leads to elimination of the danger of formation of cracks or tears, but also makes it possible to employ a tube which (in particular in the case where the tubes are made of aluminium alloys) do not need to be in any specific metallurgical condition.

In this connection, the invention makes it possible to use a cold-formed tube, which is accordingly less expensive because it has not been subjected to heat treatment. In addition, such a tube in the cold-formed state has the advantage that it is directly lubricated in drawing, which removes the need for any additional lubricating operation during the formation of the tube bundle of the heat exchanger.

In a preferred embodiment of the invention, the expanded mouth of each tube has a four-sided polygonal shape. The expanded mouth may accordingly be square in shape, especially in the case where the tube end portion has a strictly circular shape.

The expanded mouth may comprise either a wall portion having generatrices parallel to the axis of the tube, or a wall portion which is generally frusto-conical.

The invention is most particularly applicable to a heat exchanger which includes a compressible sealing gasket, for example of an elastomeric material, and which is formed with compressible collar portions. Each through hole of the header plate is bounded by a corresponding collar portion of the header plate, and each collar portion of the sealing gasket is interposed between the corresponding header plate collar portion and the end portion of the tube received in the corresponding through hole.

According to a preferred feature of the invention, the expanded mouth of each tube end portion serves as an enlarged retaining head for the tube.

According to another preferred feature of the invention, each tube in the bundle is made of a metal alloy, especially an aluminium alloy, in the cold-formed state.

The invention will be more clearly understood on a reading of the description of preferred embodiments of the invention which follows, and which is given by way of example only and with reference to the accompanying drawings.

DESCRIPTION OF PREFERRED EMBODIMENTS OF THE INVENTION

Figure 1:
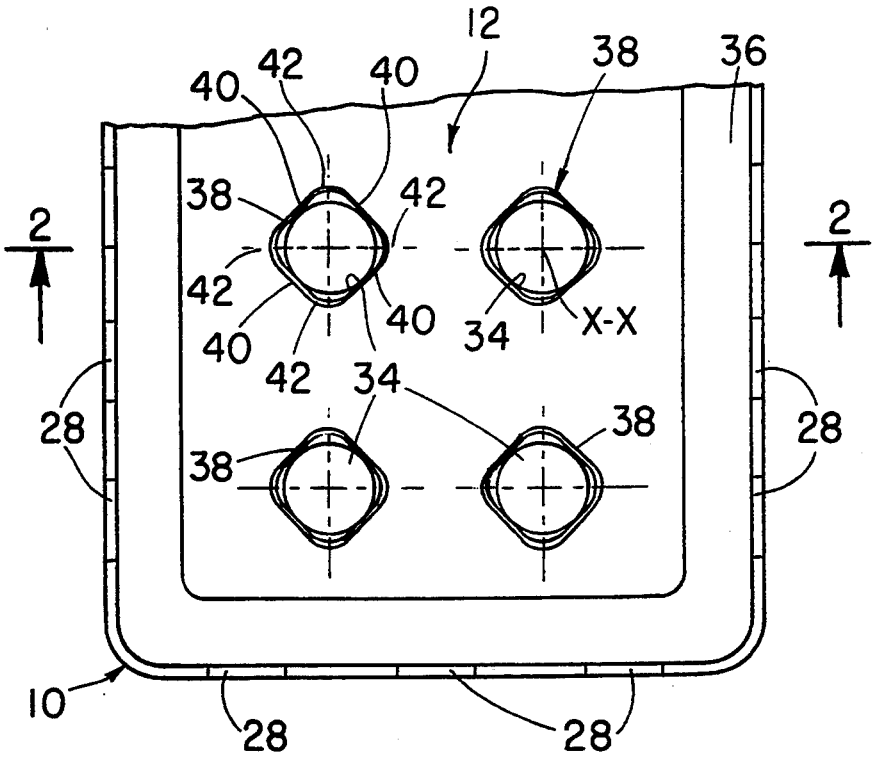
FIG. 1 is a top plan view showing part of a header plate of a heat exchanger, with a sealing gasket and tubes received by this header plate, each of the tubes being formed with an expanded end portion in accordance with the present invention.
Figure 2:
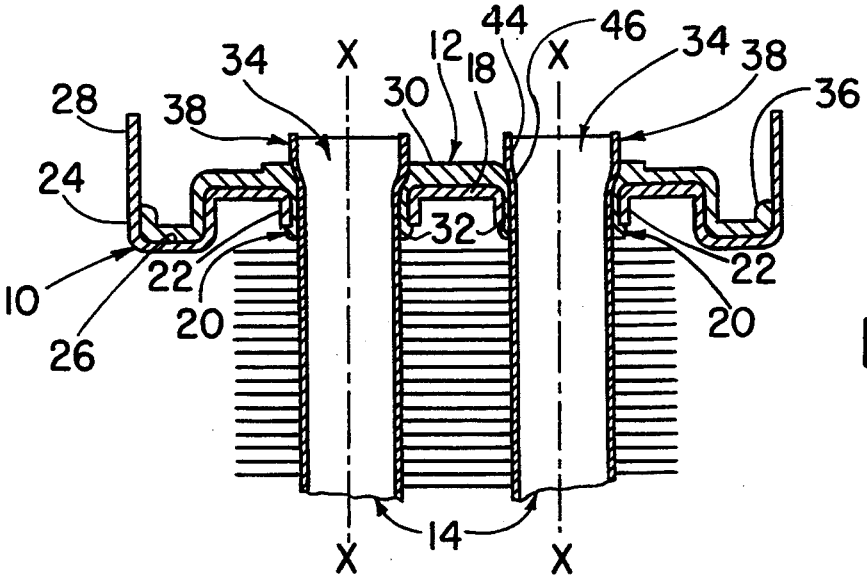
FIG. 2 is a partial view in cross section taken on the line II—II in FIG. 1.

The heat exchanger shown in FIGS. 1 and 2 includes a header plate 10, a compressible sealing gasket 12, and a tube bundle which consists of a multiplicity of tubes 14 with respective parallel axes XX. The tubes 14 are arranged in two parallel rows, and they extend through a multiplicity of cooling fins 16 which extend at right angles to the axes of the tubes.

The header plate 10 has a central body portion 18 of generally rectangular shape, in which a multiplicity of circular through holes 20 are formed. These holes 20 correspond to the tubes 14 of the tube bundle. Each hole 20 is bounded with an integral collar portion 22 of the header plate. Each collar portion 22 projects from the body portion 18 towards the cooling fins 16. The header plate 10 also has a peripheral flange 24 which defines a peripheral groove 26 and a multiplicity of deformable lugs 28, which are capable of being bent over.

The compressible sealing gasket 12 is preferably made of an elastomeric material, and comprises a body portion or web 30 which is applied against the body portion 18 of the header plate 10. The body portion 30 of the gasket is formed with integral, compressible collar portions 32. Each collar portion 32 is arranged to be compressed between a respective one of the collar portions 22 of the header plate and the end portion 34 of a corresponding heat exchanger tube 14. These tube end portions 34 are of circular cross section. The web 30 of the sealing gasket 12 is provided with a flange 36 which is received in the groove 26 of the header plate, and which is arranged to be compressed by the peripheral edge (not shown) of a header wall or cover (not shown), which, with the header plate 10, constitutes a fluid header of the heat exchanger. Sealing between the header cover and the header plate is obtained in the usual way by compression of the flange 36 after the deformable lugs 28 have been bent over.

As so far described here, the general structure of the heat exchanger is known per se. Each compressible collar portion 32 of the gasket is compressed between a corresponding collar portion 22 of the header plate and the end portion 34 of the corresponding tube 14, which ensures that the connection between the header plate and the tubes of the bundle is sealed.

In the arrangement shown in the drawings, each tube end portion 34 has an expanded mouth 38 (FIGS. 1 and 2) which is obtained by deformation of the wall of the tube in a radial direction with respect to the tube axis XX, using an appropriate expanding tool such as a punch (not shown). The operation of forming each of these expanded mouths is carried out on the side of the header plate which carries the sealing gasket 12, that is to say on the side opposite to that which faces towards the cooling fins 16.

Each expanded mouth 38 has a polygonal shape which, in this example and as can be seen in FIG. 1, is square, this being defined by four sides 40 which are joined together through rounded corners 42. The formation of such a polygonal expanded mouth, with rounded corners, enables the tube to be made with a reduced amount of elongation as compared with the amount which it would undergo if the expanded mouth were circular as in the prior art. As already explained, this enables any danger of cracks or tears to be avoided, and also enables a metallic tube to be used which does not call for any particular specific metallurgical condition.

The tubes are preferably made of an aluminium alloy, or of another suitable ductile metal alloy. As already explained, it is possible to use a tube in the cold-formed state. This is less costly than a tube which has been subjected to heat treatment, and has the further advantage that the tube material is directly lubricated by drawing, which avoids the need for any additional lubricating operation during assembly of the tube bundle of the heat exchanger.

In the embodiment shown in FIGS. 1 and 2, the expanded mouth 38 of each tube comprises a wall portion 44 which is delimited by generatrices parallel to the axis XX of the tube, and which are joined to the main body of the tube through a shoulder 46. The expanded mouth 38 retains the header plate 10 on the bundle of tubes 14.

Figure 3:
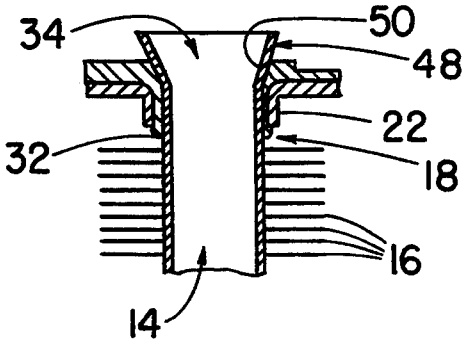
FIG. 3 is a partial view in cross section, similar to that of FIG. 2, but showing a modified embodiment.

Referring now to FIG. 3, showing a modified embodiment, the end portion 34 of each tube in the bundle here comprises an expanded mouth 48 which consists of a wall portion 50 of generally frustoconical shape.

It will be seen that the invention enables a heat exchanger to be made in which the header plate is perfectly retained in position with respect to the tube bundle. The expanded mouths described above and shown in the drawings are used primarily in heat exchangers of the kind which are mechanically assembled together. They may however also be used for heat exchangers of the brazed type, in order to ensure mechanical fastening of the header plate on the tube bundle prior to the brazing operation.

If necessary, each tube may have another expanded portion which is not polygonal. Such an additional expanded portion can be made in a known manner in the part of the tube lying on the same side of the header plate as the cooling fins 16.

The invention is most particularly applicable to heat exchangers for motor vehicles.

What is claimed is:

1. A heat exchanger comprising a tube bundle comprising a plurality of tubes, and a header plate formed with substantially circular through holes, each said tube having a tube wall with a shaped tube end portion received sealingly in a respective said hole in the header plate, each said shaped end portion defining an expanded mouth made by deformation of the tube wall, wherein each said tube end portion has at lease three sides and rounded corners joining the three sides, so as to define a polygonal shape of said expanded mouth.

2. A heat exchanger according to claim 1, wherein each said expanded mouth defines a four-sided polygon.

3. A heat exchanger according to claim 1, wherein each said expanded mouth is square.

4. A heat exchanger according to claim 1, wherein each said tube defines a tube axis and a wall portion having generatrices parallel to said tube axis, said wall portion defining said expanded mouth.

5. A heat exchanger according to claim 1, wherein said expanded mouth of each tube comprises a generally frusto-conical wall portion of the tube.

6. A heat exchanger according to claim 1, wherein the header plate further includes a plurality of first collar portions, each bounding a said through hole in the header plate, the heat exchanger further including a compressible sealing gasket formed with a plurality of compressible second collar portions, each of which is interposed between a respective said first collar portion and said end portion of a tube of the tube bundle received in the hole, wherein said expanded mouth acts as an enlarged head of the tube, retaining the said enlarged head in said hole.

7. A heat exchanger according to claim 1, wherein each said tube is made of a cold formed metallic material.

* * * * *